US011192111B2

(12) United States Patent
Kai

(10) Patent No.: US 11,192,111 B2
(45) Date of Patent: Dec. 7, 2021

(54) DROPLET COLLECTION DEVICE

(71) Applicant: TOHOKU UNIVERSITY, Miyagi (JP)

(72) Inventor: Hiroyuki Kai, Miyagi (JP)

(73) Assignee: TOHOKU UNIVERSITY, Miyagi (JP)

( * ) Notice: Subject to any disclaimer, the term of this patent is extended or adjusted under 35 U.S.C. 154(b) by 221 days.

(21) Appl. No.: 16/699,316

(22) Filed: Nov. 29, 2019

(65) Prior Publication Data

US 2020/0179934 A1 Jun. 11, 2020

(30) Foreign Application Priority Data

Nov. 30, 2018 (JP) ..... JP2018-224402

(51) Int. Cl.
*B01L 3/00* (2006.01)

(52) U.S. Cl.
CPC . *B01L 3/502792* (2013.01); *B01L 2200/0636* (2013.01); *B01L 2300/165* (2013.01)

(58) Field of Classification Search
CPC ..... B01L 2200/0636; B01L 2300/0816; B01L 2300/0883; B01L 2300/089; B01L 2300/165; B01L 2300/166; B01L 2400/0406; B01L 2400/088; B01L 3/502707; B01L 3/50273; B01L 3/502746; B01L 3/502792
See application file for complete search history.

(56) References Cited

PUBLICATIONS

Bai, H., Wang, L., Ju, J., Sun, R., Zheng, Y. and Jiang, L. (2014), Efficient Water Collection on Integrative Bioinspired Surfaces with Star-Shaped Wettability Patterns. Adv. Mater., 26: 5025-5030. https://doi.org/10.1002/adma.201400262 (Year: 2014).*

(Continued)

*Primary Examiner* — Jennifer Wecker
*Assistant Examiner* — Jonathan Bortoli
(74) *Attorney, Agent, or Firm* — Wenderoth, Lind & Ponack, L.L.P.

(57) ABSTRACT

Provided is a liquid droplet collection device including: a substrate having a hydrophobic surface; and a hydrophilic channel arranged in the hydrophobic surface, wherein the hydrophilic channel includes: a first-generation channel including a plurality of tapered channel portions radially extending from an origin point and monotonically tapering with increasing distance from the origin point; and a second-generation channel that includes a plurality of tapered channel portions radially extending from an origin point and monotonically tapering with increasing distance from the origin point, and is scaled down in size as compared to the first-generation channel, wherein the second-generation channel is joined to the first-generation channel to face the same direction as the first-generation channel, and wherein one of the tapered channel portions of the second-generation channel overlaps a distal end portion of one of the tapered channel portions of the first-generation channel, and the hydrophilic channel monotonically tapers from a proximal end of one of the tapered channel portions of the first-generation channel to a distal end of one of the tapered channel portions of the second-generation channel.

9 Claims, 14 Drawing Sheets

(56) References Cited

PUBLICATIONS

Yongping Chen, Feng Yao, Xiangyong Huang, (2015) Mass transfer and reaction in methanol steam reforming reactor with fractal tree-like microchannel network, International Journal of Heat and Mass Transfer, vol. 87, pp. 279-283, ISSN 0017-9310 (Year: 2015).*

Ghosh et al., "Wettability patterning for high-rate, pumpless fluid transport on open, non-planar microfluidic platforms", Lab on a Chip, 2014, vol. 14, No. 9, pp. 1538-1550.

Wang et al., "Laser Direct Writing of Tree-Shaped Hierarchical Cones on a Superhydrophobic Film for High-Efficiency Water Collection", ACS Appl. Mater. Interfaces, 2017, vol. 9, No. 34, pp. 29248-29254.

Toyosato et al., "Development of flexible sweat-collecting devices", The 35th meeting of Society for Chemisuy and Micro-Nano Systems (CHEMINAS), 2017, 2 pages, with English Abstract.

Toyosato et al., "Development of solution collecting films by hierarchical wettability patterning", The 27th meeting of Materials Research Society of Japan, 2017, 1 page, with English abstract.

Kai et al., "Water collection by hierarchical patterning of surface wettability", The 78 the JSAP Autumn Meeting 2017, 2 pages, with English Abstract.

Toyosato et al., "Development of flexible liquid collecting film by spatial control of surface wettability", The Electrochemical Society of Japan TOHOKU Branch 48th Semi conference, 2 pages, with English abstract.

Kai et al., "Mechanism for droplet collection by open microfluidic channels with hierarchically branching structures", Chemistry and Micro-Nano Systems, 2018, vol. 17, No. 2, pp. 33-36, with English Translation.

Notice of Reasons for Refusal dated May 19, 2020 in corresponding Japanese Patent Application No. 2018-224402, with English Translation.

* cited by examiner

DROPLET COLLECTION DEVICE

CROSS REFERENCE TO RELATED APPLICATION

The present application claims the benefit of Japanese Patent Application No. 2018-224402, filed on Nov. 30, 2018, which is incorporated by reference herein in its entirety.

TECHNICAL FIELD

The present invention relates to a liquid droplet collection device.

BACKGROUND ART

Recovery of water from water vapor or fine water droplets is useful for, for example, securing water in a dry area or recovering a minute amount of an analyte solution. There has been developed a water vapor-condensing or water droplet-recovering mechanism using a substrate subjected to surface treatment for wettability. However, hitherto, means for collecting condensed liquid droplets in one place from a large area has been limited to the gravitational fall of liquid droplets.

In recent years, research into open microfluidics involving controlling movement of liquid on a substrate surface has been advanced. It has been disclosed that, when open channels each having a gradient in width at both ends thereof are produced by patterning superhydrophilic regions each having an elongated band shape on a superhydrophobic substrate surface through ultraviolet light irradiation, liquid droplets can be rapidly transported from portions of the channels having smaller widths to portions thereof having larger widths (Lab Chip. 2014; 14(9): 1538-1550, ACS Appl. Mater. Interfaces, 2017 9(34), p. 29248-29254).

The inventors of the present invention formed a highly hydrophilic channel having a gradient in channel width on a superhydrophobic substrate surface, to thereby produce a microchannel device configured to rapidly transport liquid toward a direction of a larger channel width into a sensor portion at one place (proceedings of CHEMINAS35 (2017)).

Further, the inventors of the present invention produced a superhydrophilic channel having a hierarchical fractal branched structure (space-filling tree) on a superhydrophobic substrate surface, and evaluated the product for its liquid droplet collection performance (proceedings of the 27th Annual Meeting of MRS-J (2017)). This device having channels having a pattern of the fractal branched structure was effective for collecting water droplets from the entire substrate surface, but had room for consideration for a shape of the pattern and an ability to collect liquid droplets.

An object of the present invention is to provide a liquid droplet collection device including a hierarchically branched hydrophilic channel, which is capable of efficiently collecting liquid droplets from a large area through active transport.

SUMMARY OF INVENTION

According to one aspect of the present invention, there is provided a liquid droplet collection device including: a substrate having a hydrophobic surface; and a hydrophilic channel arranged in the hydrophobic surface, wherein the hydrophilic channel includes: a first-generation channel including a plurality of tapered channel portions radially extending from an origin point and monotonically tapering with increasing distance from the origin point; and a second-generation channel that includes a plurality of tapered channel portions radially extending from an origin point and monotonically tapering with increasing distance from the origin point, and is scaled down in size as compared to the first-generation channel, wherein the second-generation channel is joined to the first-generation channel to face the same direction as the first-generation channel, and wherein one of the tapered channel portions of the second-generation channel overlaps a distal end portion of one of the tapered channel portions of the first-generation channel, and the hydrophilic channel monotonically tapers from a proximal end of one of the tapered channel portions of the first-generation channel to a distal end of one of the tapered channel portions of the second-generation channel.

BRIEF DESCRIPTION OF DRAWINGS

FIG. 12A: a hydrophilic channel formed of repeating units including up to fourth-generation channels, FIG. 12B: a hydrophilic channel formed of repeating units including up to sixth-generation channels.

In FIG. 17A, general views of the entirety of a film, on which water droplets have been sprayed, for 1.1 seconds after the spraying are shown. In FIG. 17B, partially enlarged perspective view of the film, on which water droplets have been sprayed, for 0.95 second after the spraying are shown. The scale bar in FIG. 17A represents 5 mm, and the scale bar in FIG. 17B represents 5 mm.

DESCRIPTION OF EMBODIMENTS

As used herein, the term "superhydrophobic" refers to a case in which the contact angle of water is 150° or more. The term "hydrophobic" refers to a case in which the contact angle of water is 90° or more. The term "hydrophilic" refers to a case in which the contact angle of water is less than 90°. The term "superhydrophilic" refers to a case in which the contact angle of water is 100 or less. The term "hydrophobic" encompasses the concept of "superhydrophobic" and the term "hydrophilic" encompasses the concept of "superhydrophilic".

A contact angle was measured in accordance with the sessile drop method of JISR3257. The contact angle was calculated by acquiring an image of a liquid droplet and analyzing the contour shape of the liquid droplet from the resultant image.

The term "liquid droplet" refers to a water droplet, a droplet of an aqueous solution having a medium dissolved therein, or a droplet of an aqueous dispersion having a medium dispersed therein.

Embodiments of the present invention are described below with reference to the drawings.

First Embodiment

Figure 1:
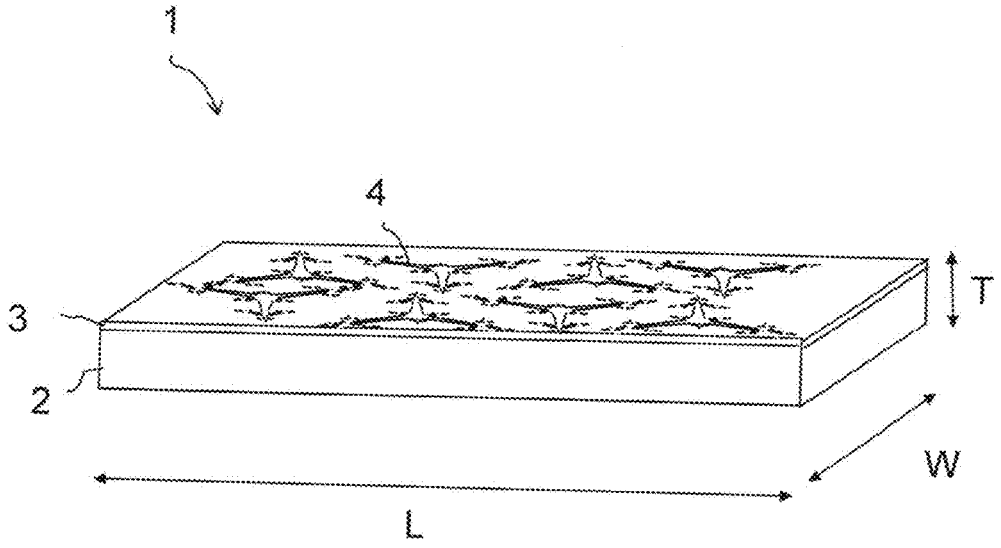
FIG. 1 is a schematic perspective view illustrating a liquid droplet collection device according to a first embodiment of the present invention.

As illustrated in FIG. 1, a liquid droplet collection device 1 according to a first embodiment of the present invention includes a substrate 2 having a hydrophobic surface 3 and hydrophilic channels 4 arranged in the hydrophobic surface 3.

The substrate 2 is a flat plate-shaped member, and may be a film or a sheet. The term "film" refers to a layer of an object having a thickness of 200 μm or less, and the "sheet" refers to an object having a larger thickness.

A material for the substrate 2 is not particularly limited, and may be a synthetic resin, a rubber, glass, silicon, a metal, or any other material through which liquid droplets do not penetrate. In terms of flexibility, the substrate 2 preferably includes the synthetic resin, and is more preferably formed of the synthetic resin. Examples of the synthetic resin include a polyethylene terephthalate resin, a polyolefin resin, a polyester resin, and an epoxy resin.

A length L, a width W, and a thickness T of the substrate 2 are not particularly limited, but in this embodiment, are set to from about 2 mm to about 100 mm, from about 2 mm to about 100 mm, and from about 0.01 mm to about 1 mm, respectively.

The hydrophobic surface 3 is formed by a hydrophobic coating formed on the surface of the substrate 2. The hydrophobic coating may be formed by applying a hydrophobic substance or a dispersion containing a hydrophobic substance onto the substrate 2 by application means, such as a spray, a roller, or a brush, and drying the applied film.

The hydrophilic channels 4 in the hydrophobic surface 3 may be formed by any known method. For example, there is a property that the surface of the titanium oxide is rendered superhydrophilic when titanium oxide ($TiO_2$) is irradiated with light is used. By using such property, the hydrophilic channels 4 that have been rendered superhydrophilic may be formed by irradiating the hydrophobic surface 3 formed by a coating containing titanium oxide with ultraviolet light via a photomask designed in advance so as to correspond to the hydrophilic channels 4. This method is advantageous in terms of simplicity and rapidity. Such hydrophilic channels 4 are slightly observable even to the naked eye, but can be more clearly observed by being distinguished from the hydrophobic surface 3 through magnification with an optical microscope or a scanning electron microscope. Alternatively, the hydrophilic channels 4 may be formed by forming a hydrophilic oxide film ($SiO_2$) on the hydrophobic surface 3 of a silicon substrate or the like by a chemical vapor deposition method.

Figure 2:
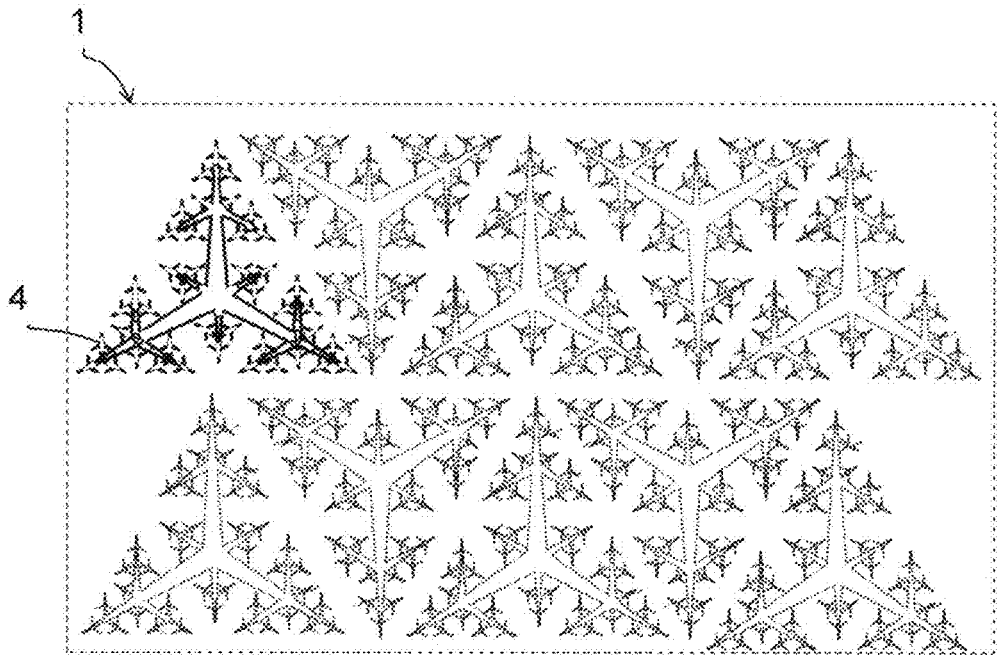
FIG. 2 is an enlarged plan view of the liquid droplet collection device, illustrating the structural pattern of the hierarchical branching of hydrophilic channels on a substrate surface.
Figure 3:
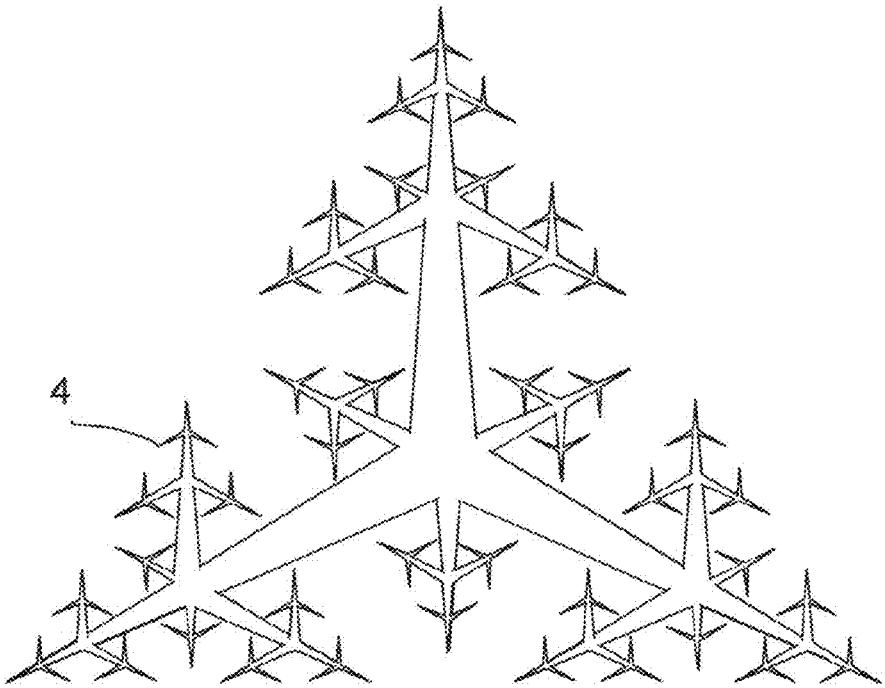
FIG. 3 is a partially enlarged plan view illustrating a single unit of the structural pattern of FIG. 2.
Figure 4:
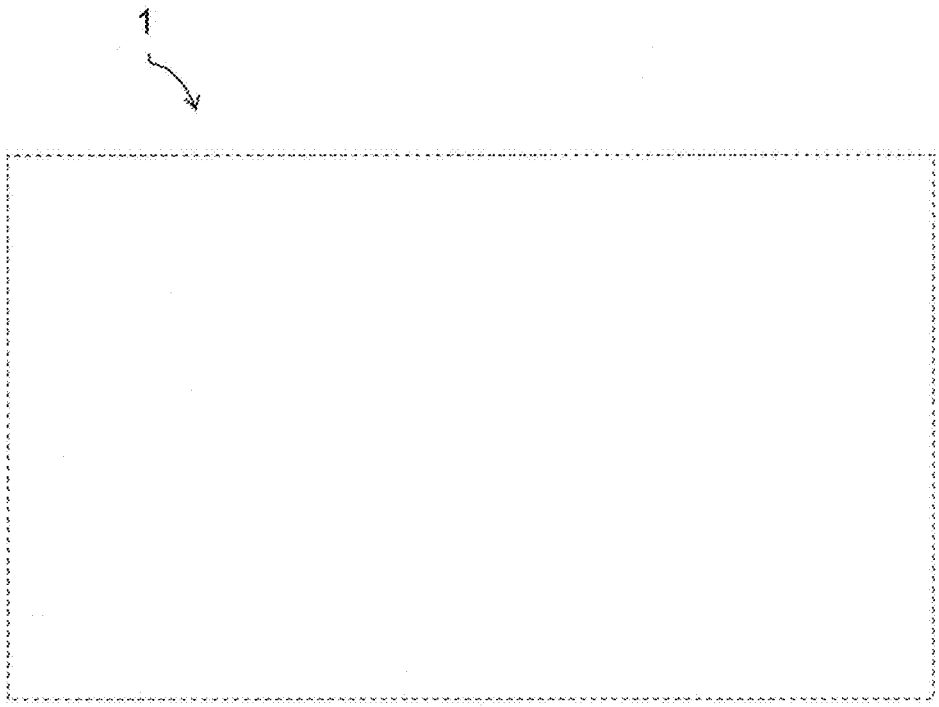
FIG. 4 is a bottom view of the liquid droplet collection device of FIG. 2.
Figure 5:
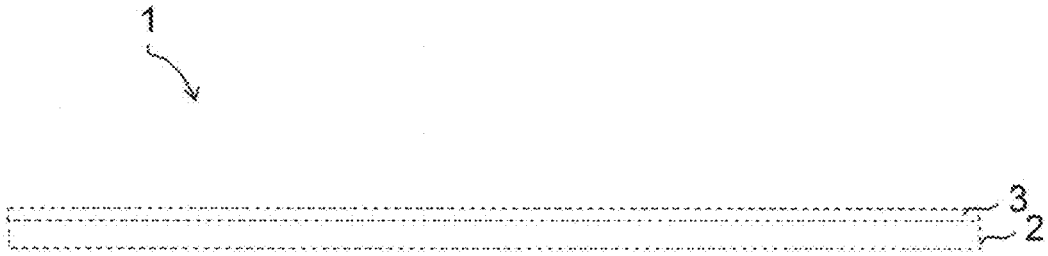
FIG. 5 is a front view of the liquid droplet collection device of FIG. 2.
Figure 6:
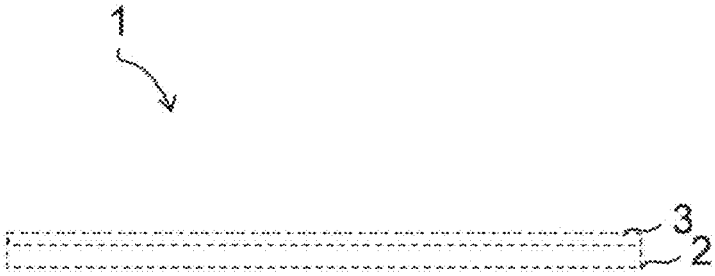
FIG. 6 is a right side view of the liquid droplet collection device of FIG. 2.

FIG. 2 is an enlarged plan view of the liquid droplet collection device of FIG. 1, illustrating the structural pattern of the hierarchical branching of the hydrophilic channels 4 in more detail. FIG. 3 is a partially enlarged view illustrating a single unit of the structural pattern of FIG. 2 (the single unit is particularly represented by solid lines in the upper left corner of FIG. 2). FIG. 4 is a bottom view of the liquid droplet collection device of FIG. 2. FIG. 5 is a front view of the liquid droplet collection device of FIG. 2, and a rear view thereof is omitted since it is the same as the front view. FIG. 6 is a right side view of the liquid droplet collection device of FIG. 2, and a left side view thereof is omitted since it is the same as the right side view.

Figure 7:
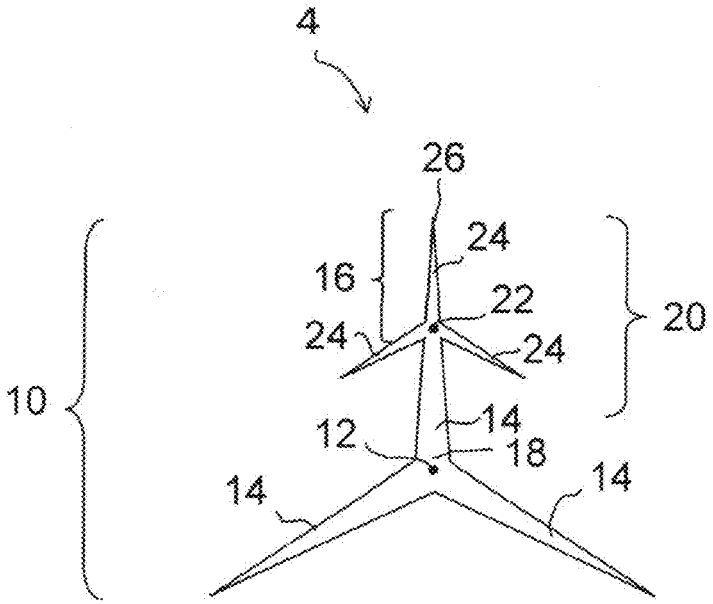
FIG. 7 is a partially enlarged view illustrating the basic structure of the first generation and second generation of the hydrophilic channel of the liquid droplet collection device of FIG. 2.

FIG. 7 is a partially enlarged view illustrating the basic structure of the first generation and second generation of the hydrophilic channel 4 of the liquid droplet collection device of FIG. 2.

The hydrophilic channel 4 includes a first-generation channel 10 and a second-generation channel 20. The first-generation channel 10 includes three tapered channel portions 14 radially extending from an origin point 12, which also serves as the center of the channel 10, and monotonically tapering with increasing distance from the origin point 12. The three tapered channel portions 14 are arranged at mutually equal intervals with central angles of 120°. The second-generation channel 20 also includes three tapered channel portions 24 radially extending from the original center 22 and monotonically tapering with increasing distance from the origin point 22, which also serves as the center of the channel 20. The second-generation channel 20 has a substantially identical shape to the shape of the first-generation channel 10, and is scaled down in size as compared to the first-generation channel. The scale rate of the second-generation channel 20 with respect to the first-generation channel 10 is preferably from 20% to 80%, more preferably from 30% to 70%, most preferably from 40% to 60%. The term "substantially identical shape" means the inclusion of even a case in which there is an error that is inevitable in design. In addition, the term "monotonically tapering" refers to linearly tapering without increasing in width in the middle.

When the first-generation channel 10 is regarded as an equilateral triangle connecting the three tapered channel portions 14, in this embodiment, the length of each side of the equilateral triangle is from about 2 mm to about 100 mm. In addition, when the second-generation channel 20 is regarded as an equilateral triangle connecting the three tapered channel portions 24, in this embodiment, the length of each side of the equilateral triangle is from about 2 mm to about 100 mm.

The three second-generation channels 20 are joined to the first-generation channel 10 so as to face the same direction as the first-generation channel 10. In addition, one of the tapered channel portions 24 of the second-generation channel 20 overlaps a distal end portion 16 of one of the tapered channel portions 14 of the first-generation channel 10, and the hydrophilic channel 4 monotonically tapers from a proximal end 18 of one of the tapered channel portions 14 of the first-generation channel 10 to a distal end 26 of one of the tapered channel portions 24 of the second-generation channel 20. That one of the tapered channel portions 24 of the second-generation channel 20 overlaps the distal end portion 16 of one of the tapered channel portions 14 of the first-generation channel 10 means that one of the tapered channel portions 24 of the second-generation channel 20 forms the distal end portion 16 of one of the tapered channel portions 14 of the first-generation channel 10, and it may also be said that one of the tapered channel portions 24 of the second-generation channel 20 also serves as the distal end portion 16 of one of the tapered channel portions 14 of the first-generation channel 10.

Figure 8:
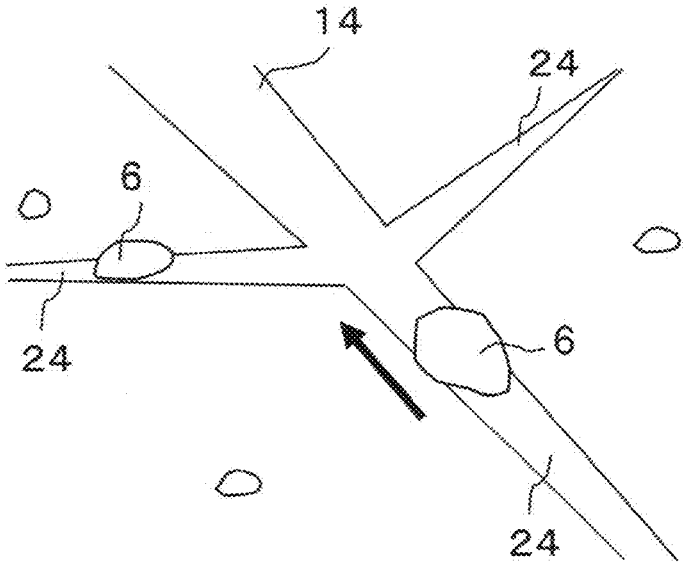
FIG. 8 is a schematic view illustrating the moving direction of a water droplet in the hydrophilic channel.

As illustrated in more detail in FIG. 8, water droplets 6 in the hydrophilic channel 4 move, as indicated by an arrow, from the tapered channel portions 24 of the second-generation channel 20, which have smaller widths, toward the tapered channel portion 14 of the first-generation channel 10, which has a larger width, and further move toward the origin point 12 of the first-generation channel 10.

As described above, the tapered channel portions 14 of the first-generation channel 10 and the tapered channel portions 24 of the second-generation channel 20 are joined to each other and monotonically taper. This configuration enables more efficient collection of liquid droplets. The collected liquid droplets accumulate in the convergence portion 18 at which the tapered channel portions 14 of the first-generation channel 10 including the origin point 12 converge.

The liquid droplet collection device according to the first embodiment of the present invention includes open channels having a space-filling tree structure, in which channels of generations descending to a fourth generation are repeated. Therefore, the configurations of second-generation, third-generation, and fourth-generation channels are described in more detail. The term "space-filling tree" refers to a structure branching into hierarchically descending generations, among fractals each representing a figure containing, as parts thereof, shapes similar to the whole figure.

Figure 9:
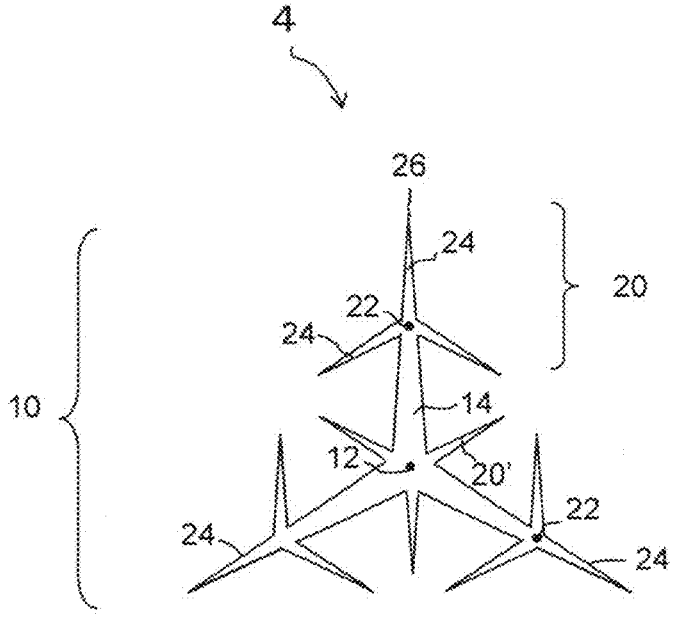
FIG. 9 is a schematic view of a hydrophilic channel formed of repeating units including up to second-generation channels.

FIG. 9 is a schematic view of part of the hydrophilic channel formed of repeating units including up to the second-generation channels. To each of the three tapered channel portions 14 of the first-generation channel 10, the second-generation channel 20 is joined to the first-generation channel 10 so as to face the same direction as the first-generation channel 10. Accordingly, each of the three tapered channel portions 14 of the first-generation channel 10 further branches into the three tapered channel portions 24 of the second-generation channel 20.

Further, there is also arranged a second-generation channel 20' in such a manner that the origin point 12 of the first-generation channel 10 and the origin point 22 of the second-generation channel 20 overlap each other, and in a direction rotationally symmetric by 180° with respect to the first-generation channel 10. The second-generation channel 20' is also a second-generation channel, but is denoted by reference symbol "20'" in order to facilitate understanding. When the second-generation channel 20' is arranged at this place as well, the hydrophilic channel 4 can be more densely arranged in a given area on the substrate 2, and hence liquid droplets can be more efficiently collected toward the origin point 12 of the first-generation channel 10.

Figure 10:
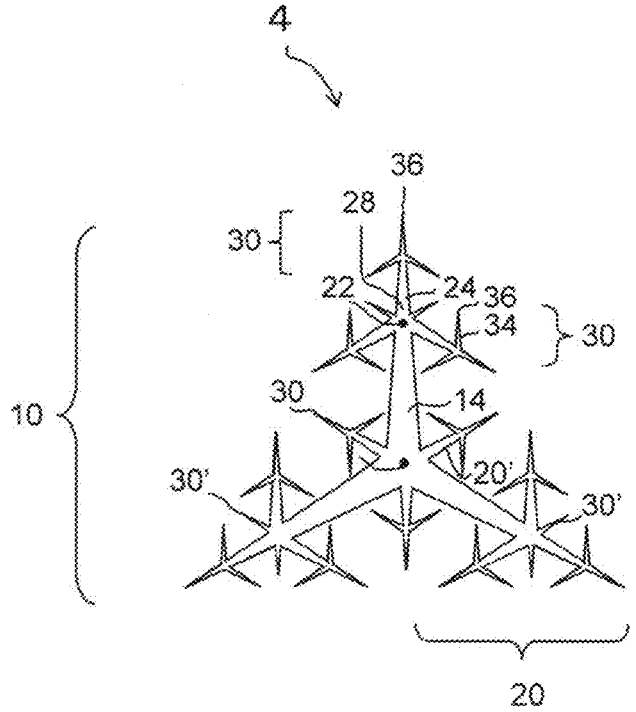
FIG. 10 is a schematic view of a hydrophilic channel formed of repeating units including up to third-generation channels.

FIG. 10 is a schematic view of part of the hydrophilic channel formed of repeating units including up to the third-generation channels. The configurations of the first-generation channel 10 and the second-generation channels 20, 20' are the same as in FIG. 9.

Twelve third-generation channels 30 are joined, three to each of the four second-generation channels 20, 20', and the direction of each third-generation channel 30 is the same as the direction of the second-generation channel 20, 20' to which the third-generation channel 30 is joined. In addition, one of tapered channel portions 34 of the third-generation channel 30 overlaps the distal end portion 26 of one of the tapered channel portions 24 of the second-generation channel 20, 20', monotonically tapering from a proximal end 28 of one of the tapered channel portions 24 of the second-generation channel 20, 20' to a distal end 36 of one of the tapered channel portions 34 of the third-generation channel 30. The meaning of "overlap" is as described above for the overlap of the tapered channel portions 14 of the first-generation channel 10 and the tapered channel portions 24 of the second-generation channel 20.

Further, there is also arranged a third-generation channel 30' in such a manner that the origin point 22 of the second-generation channel 20 and an origin point 32 serving as the center of the third-generation channel 30' overlap each other, and in a direction rotationally symmetric by 180° with respect to the second-generation channel 20. The third-generation channel 30' is also a third-generation channel, but is denoted by reference symbol "30'" in order to facilitate understanding. When the third-generation channel 30' is arranged at this place as well, the hydrophilic channel 4 can be more densely arranged in a given area on the substrate 2, and hence liquid droplets can be more efficiently collected toward the origin point 12 of the first-generation channel 10. Even when the third-generation channel 30' is arranged in a direction rotationally symmetric by 180° with respect to the second-generation channel 20', it completely overlaps with the first-generation channel 10, and hence is not shown.

Figure 11:
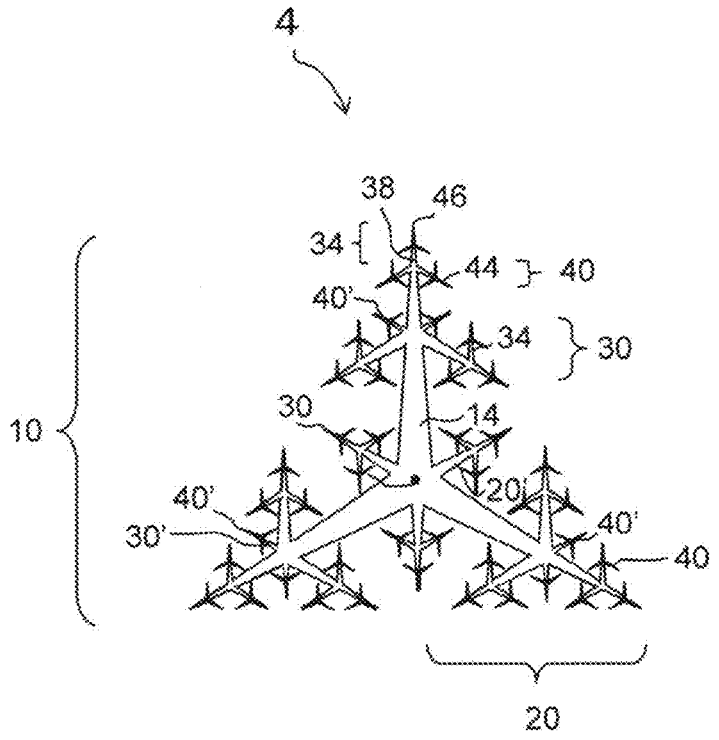
FIG. 11 is a schematic view of a hydrophilic channel formed of repeating units including up to fourth-generation channels.

FIG. 11 is a schematic view of part of the hydrophilic channel formed of repeating units including up to the fourth-generation channels. The configurations of the first-generation channel 10, the second-generation channels 20, 20', and the third-generation channels 30, 30' are the same as in FIG. 10.

Forty-eight fourth-generation channels 40 are joined, three to each of the sixteen third-generation channels 30, 30', and the direction of each fourth-generation channel 40 is the same as the direction of the third-generation channel 30, 30' to which the fourth-generation channel 40 is joined. In addition, one of tapered channel portions 44 of the fourth-generation channel 40 overlaps the distal end portion 36 of one of the tapered channel portions 34 of the third-generation channel 30, 30', monotonically tapering from a proximal end 38 of one of the tapered channel portions 34 of the third-generation channel 30, 30' to a distal end 46 of one of the tapered channel portions 44 of the fourth-generation channel 40. The meaning of "overlap" is as described above for the overlap of the tapered channel portions 14 of the first-generation channel 10 and the tapered channel portions 24 of the second-generation channel 20.

Further, there is also arranged a fourth-generation channel 40' in such a manner that the origin point 32, which also serves as the center of the third-generation channel 30, and an origin point 42, which also serves as the center of the fourth-generation channel 40, overlap each other, and in a direction rotationally symmetric by 180° with respect to the third-generation channel 30. The fourth-generation channel 40' is also a fourth-generation channel, but is denoted by reference symbol "40'''" in order to facilitate understanding. When the fourth-generation channel 40' is arranged at this place as well, the hydrophilic channel 4 can be more densely arranged in a given area on the substrate 2, and hence liquid droplets can be more efficiently collected toward the origin point 12 of the first-generation channel 10. In FIG. 11, three fourth-generation channels 40'' are arranged also at positions to be joined to the third-generation channel when the third-generation channel is arranged in a direction rotationally symmetric by 180° with respect to the second-generation channel 20'.

As described above, the liquid droplet collection device according to the first embodiment of the present invention includes open channels having a fractal structure in which channels of generations descending to the fourth generation are repeated. In addition, a plurality of the first-generation channels 10 are arranged in the hydrophobic surface 3, and channels of generations descending to the fourth generation are repeated with respect thereto to form the hydrophilic channel 4. Accordingly, liquid droplets can be efficiently collected toward the first-generation channels 10. From the viewpoints of liquid droplet collection efficiency and design feasibility, it is preferred that the hydrophilic channels 4 in the hydrophobic surface 3 be set to have an area ratio of from 10% to 60% with respect to the area of the hydrophobic surface 3.

Second Embodiment

Next, a hydrophilic channel of a liquid droplet collection device according to a second embodiment of the present invention are described. Description is omitted of the same reference symbols as those of the hydrophilic channel of the liquid droplet collection device according to the first embodiment.

Figure 12A:
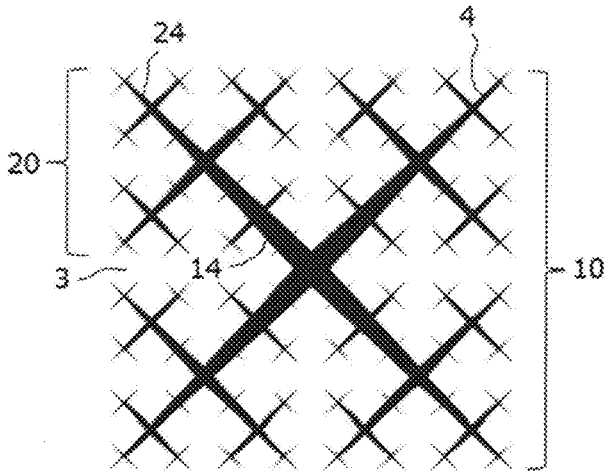
FIG. 12A and FIG. 12B are schematic plan views illustrating a hydrophilic channel of a liquid droplet collection device according to a second embodiment of the present invention.
Figure 12B:
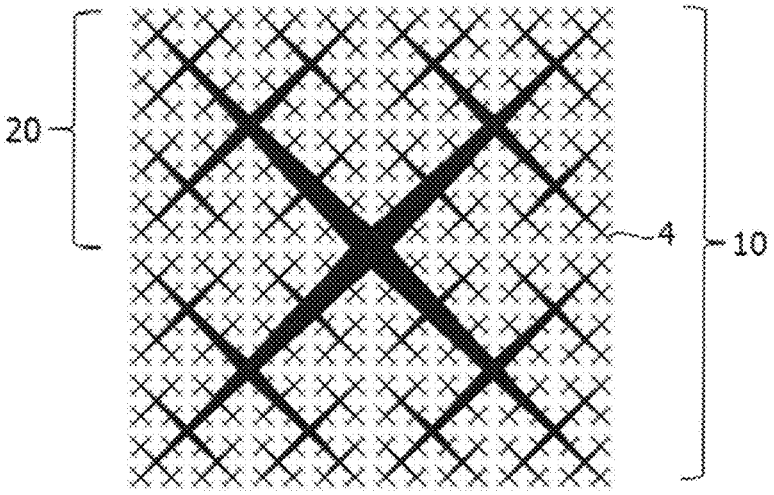

The hydrophilic channel 4 of the second embodiment illustrated in each of FIG. 12A and FIG. 12B is a single unit of a structural pattern like the hydrophilic channel of the first embodiment illustrated in FIG. 3. FIG. 12A is an illustration of a hydrophilic channel formed of repeating units including up to fourth-generation channels, and FIG. 12B is an illustration of a hydrophilic channel formed of repeating units including up to sixth-generation channels.

As illustrated in FIG. 12A and FIG. 12B, each channel 10, 20 . . . includes four tapered channel portions 14, 24 . . . radially extending from the origin point thereof. The second-generation channel 20 has a substantially identical shape to the shape of the first-generation channel 10, and is scaled down in size as compared to the first-generation channel 10. The configuration is that the tapered channel portions 14 of the first-generation channel 10 and the tapered channel portions 24 of the second-generation channel 20 are joined to each other and monotonically taper. The four tapered channel portions 14, 24 . . . are arranged at mutually equal intervals with central angles of about 90°. The second-generation channel 20 has a substantially identical shape to the shape of the first-generation channel 10, and is scaled down in size as compared to the first-generation channel.

By virtue of such configuration, liquid droplets can be efficiently collected toward the origin point 12 of the first-generation channel 10.

Third Embodiment

Next, a hydrophilic channel of a liquid droplet collection device according to a third embodiment of the present invention are described. Description is omitted of the same reference symbols as those of the hydrophilic channel of the liquid droplet collection device according to the first embodiment.

Figure 13A:
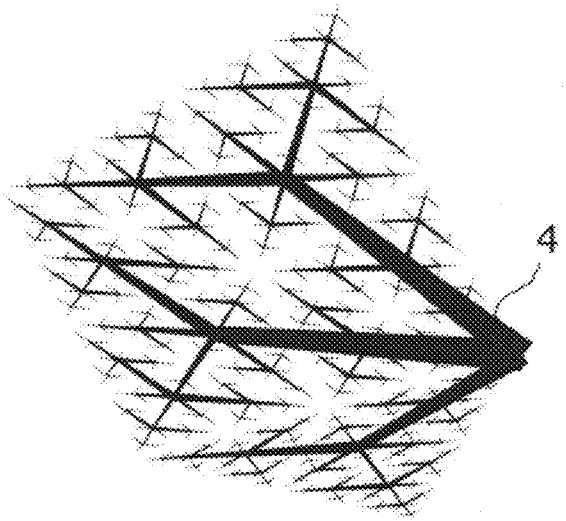
FIG. 13A is a schematic plan view illustrating a hydrophilic channel of a liquid droplet collection device according to a third embodiment of the present invention.
Figure 13B:
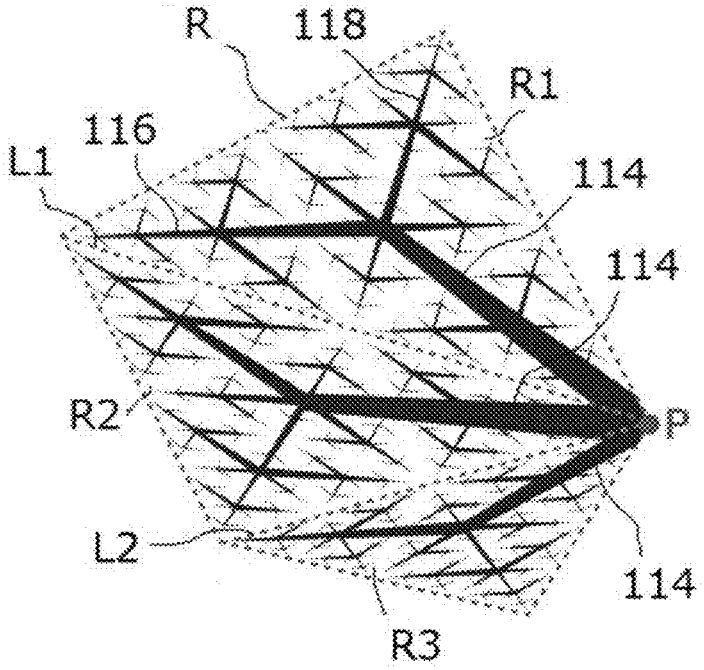
FIG. 13B is a view illustrating the hydrophilic channel of FIG. 13A in more detail.

The hydrophilic channel 4 of the third embodiment illustrated in FIG. 13A and FIG. 13B is a single unit of a pentagonal structural pattern, and is an illustration of a hydrophilic channel formed of repeating units including up to fourth-generation channels. The taper angle of each tapered channel portion is set to 3°.

In the liquid droplet collection device according to the third embodiment, for any n-gonal region ($n \geq 4$), the number of branches of the first channels branched from an origin point is $n-2$, and the number of branches of a next or subsequent generation is 3.

Specifically, a more detailed description is made with reference to FIG. 13B. When line segments are drawn from an origin point P, which is one of the vertices of a pentagonal region R indicated by dotted lines, to other vertices, (5-3) line segments L1 and L2 can be drawn. In addition, the line segments L1 and L2 divide the region R into three regions R1, R2, and R3, and three tapered channel portions 114 branched from the origin point P respectively extend in the regions.

Assuming that the tapered channel portions 114, and tapered channel portions 116 and 118 joined thereto and tapering toward triangular vertices form the first-generation channel, as in the first embodiment, in each of the three regions R1, R2, and R3, the first-generation channel branches into the second-generation channels, the third-generation channels, and the fourth-generation channels, and the number of tapered channel portions of each of the second-generation channels and the channels of the subsequent generations is 3. In this embodiment, liquid droplets can be efficiently collected toward the origin point P of the first-generation channel.

When the above-mentioned regularity is applied to a general polygon including a pentagon, any n-gon ($n \geq 4$) can be divided into $n-2$ triangles sharing the origin point P, which is a vertex of the n-gon, and hence the number of branches of the first channels is $n-2$. In addition, since the channels of a next or subsequent generation extend in the divided triangles, the number of branches thereof is 3. In the third embodiment, the following property is utilized: once a region is divided into triangles (even when the triangles are not equilateral), space-filling trees can be formed therein.

The hydrophilic channel 4 of the liquid droplet collection device according to the third embodiment may be considered to be such hydrophilic channel that: any n-gonal region (n≥4) is divided into n−2 triangular regions by imaginary line segments (L1 and L2) each connecting the origin point, which is one of the vertices of the n-gon, and another vertex of the n-gon; in each of the triangular regions, n−2 channel portions are branched from the origin point and respectively pass in the triangular regions (in particular, tapered channel portions that increase in width toward the origin point) and each of the n−2 channel portions forms one of the three channel portions of the first-generation channel radially extending from the origin point of the first-generation channel; the second-generation channels are joined to each of the three channel portions of each first-generation channel; and further, channels of generations descending to an n-th generation are repeated. The three channel portions of each first-generation channel except for the n−2 channel portions respectively passing in the triangular regions are each preferably a tapered channel portion that monotonically tapers with increasing distance from the origin point of the first generation.

Fourth Embodiment

Next, a hydrophilic channel of a liquid droplet collection device according to a fourth embodiment of the present invention are described. Description is omitted of the same reference symbols as those of the liquid droplet collection device according to the first embodiment.

Figure 14A:
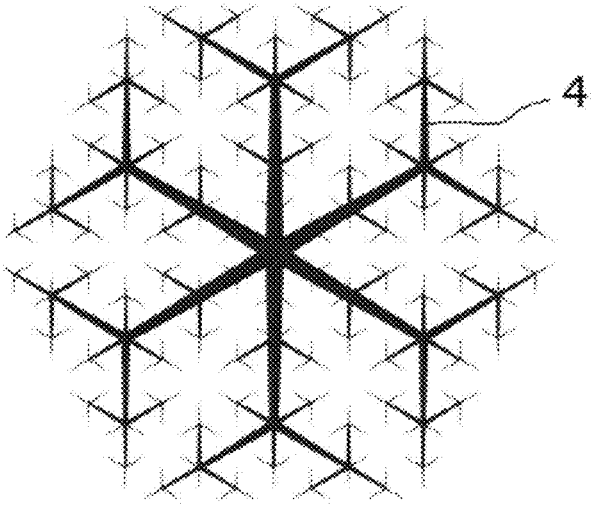
FIG. 14A is a schematic plan view illustrating a hydrophilic channel of a liquid droplet collection device according to a fourth embodiment of the present invention.
Figure 14B:
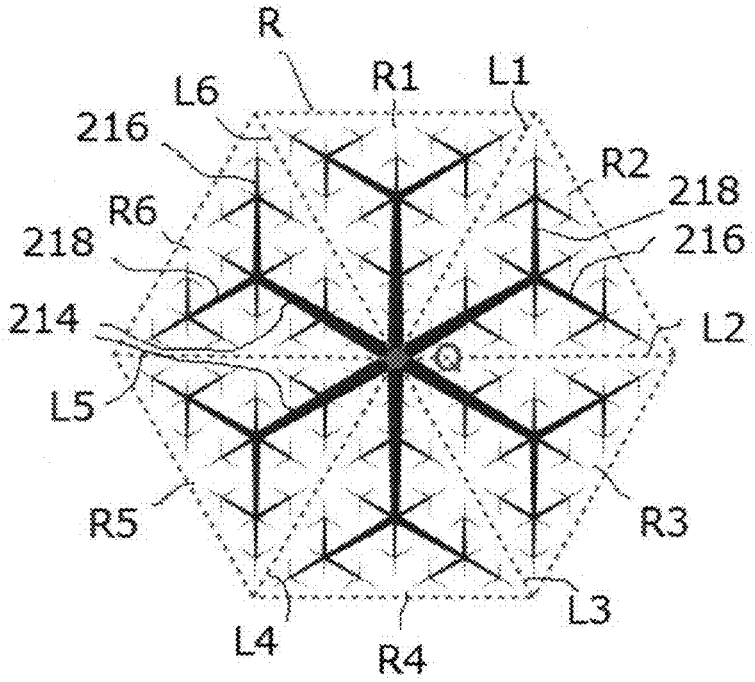
FIG. 14B is a view illustrating the hydrophilic channel of FIG. 14A in more detail.

The hydrophilic channel 4 of the fourth embodiment illustrated in FIG. 14A and FIG. 14B is a single unit of a regular hexagonal structural pattern, and is an illustration of a hydrophilic channel formed of repeating units including up to fourth-generation channels. The taper angle of each tapered channel portion is set to 3°.

In the liquid droplet collection device according to the fourth embodiment, for any n-gonal region (n≥3), the number of branches of the first channels branched from the origin point present inside the n-gonal region is n, and the number of branches of a next or subsequent generation is 3. The number of branches of a channel may be said to be the number of tapered channel portions.

Specifically, a more detailed description is made with reference to FIG. 14B. When line segments are drawn from an origin point Q, which also serves as the center of a regular hexagonal region R indicated by dotted lines, to other vertices, six line segments L1 to L6 can be drawn. In addition, the line segments L1 to L6 divide the region R into six regions R1 to R6, and six tapered channels 214 branched from the origin point Q respectively extend in the regions.

Assuming that the tapered channels 214, and tapered channels 216 and 218 joined thereto and tapering toward triangular vertices form the first-generation channel, in each of the six regions R1 to R6, as in the first embodiment, the first-generation channel branches to form the second-generation channels, the third-generation channels, and the third-generation channels, and the number of tapered channel portions of each of the second-generation channels and the channels of the subsequent generations is 3. In this embodiment, liquid droplets can be efficiently collected toward the origin point Q of the first-generation channel.

When the above-mentioned regularity is applied to a general polygon including a hexagon, any n-gon (n≥3) can be divided into n triangles sharing any one point Q present therein as a vertex, and hence the number of branches of the first channels is n. In addition, the channels of a next or subsequent generation extend in the divided triangles, and hence the number of branches thereof is 3. Also in the fourth embodiment, the following property is utilized: once a region is divided into triangles (even when the triangles are not equilateral), space-filling trees can be formed therein.

The hydrophilic channel 4 of the liquid droplet collection device according to the fourth embodiment may be considered to be such hydrophilic channel that: any n-gonal region (n≥3) is divided into n triangular regions by imaginary line segments (L1 to L6) each connecting the origin point present inside the n-gon and a vertex of the n-gon; n channel portions are branched from the origin point and respectively pass in the n triangular regions (in particular, tapered channel portions that increase in width toward the origin point) and each of the channel portions forms one of the three channels of the first-generation channel; the second-generation channels are joined to each of the three channels of each first-generation channel; and further, channels of generations descending to an n-th generation are repeated. The three channel portions of each first-generation channel except for the n channel portions respectively passing in the n triangular regions are each preferably a tapered channel portion that monotonically tapers with increasing distance from the origin point of the first-generation channel.

Although the present invention has been described above by taking the first to fourth embodiments as examples, the present invention is not limited thereto, and such various modifications as described below are possible.

The liquid droplet collection devices according to the first to fourth embodiments each have a fractal structure in which channels of generations descending to the fourth generation or the sixth generation are repeated, but it is also appropriate to have a fractal structure in which channels of generations descending to an n-th generation (n represents an integer of 2 or more) are repeated. For example, the generation number of channels counted from the first generation of the fractal structure in the liquid droplet collection device may be 2 as illustrated in FIG. 9, may be 3 as illustrated in FIG. 10, or may be 5 or more (not shown). The collection amount of liquid droplets monotonically increases until the eighth generation, and hence the generation number counted from the first generation of the fractal structure is preferably from 2 to 9, more preferably from 3 to 8.

In the first embodiment, the number of the plurality of tapered channel portions 14 of the first-generation channel 10 is 3, and in the second embodiment, the number of the plurality of tapered channel portions 14 of the first-generation channel 10 is 4. However, the following configuration may also be provided: the number of the plurality of tapered channel portions 14 of the first-generation channel 10 is set to n (n represents 2 or more) and n second-generation channels 20 are correspondingly joined to the plurality of tapered channel portions 14 of the first-generation channel 10. Further, with regard to the second-generation channel 20 and the third-generation channel 30, n third-generation channels 30 may be joined to one second-generation channel 20, and such configuration may be repeated through channels of a plurality of descending generations.

Figure 15A:
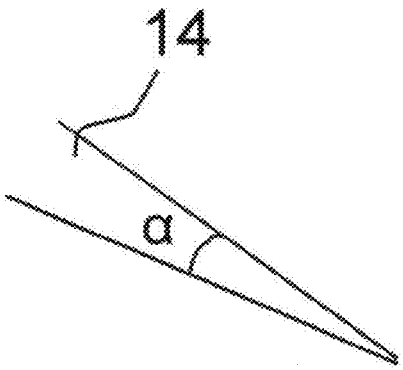
FIG. 15A is a schematic view illustrating the taper angle of a tapered channel portion.
Figure 15B:
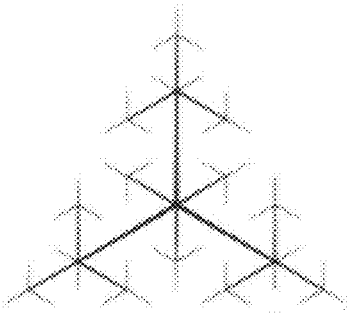
FIG. 15B is a schematic view of the hierarchical structure of a hydrophilic channel in the case where the taper angle is 1°.
Figure 15C:
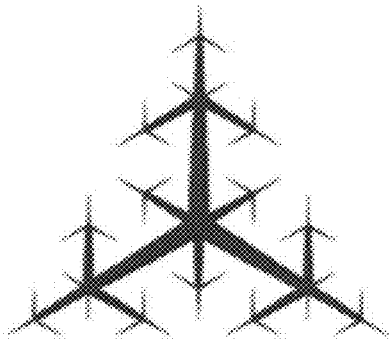
FIG. 15C is a schematic view of the hierarchical structure of a hydrophilic channel in the case where the taper angle is 5°.

The taper angle (also referred to as opening angle) of each tapered channel portion of the first to fourth embodiments may be changed as appropriate. In FIG. 15A, the taper angle of the tapered channel portion 14 of the first-generation channel 10 is represented by α. FIG. 15B is an illustration of the structure of a hydrophilic channel in the case where the taper angle of each of the tapered channel portions of the channels of each generation (that is, all generations) is 1°, and FIG. 15C is an illustration of the structure of a hydrophilic channel in the case where the taper angle of each of the tapered channel portions of the channels of each generation (that is, all generations) is 5°.

In the first embodiment and the second embodiment, the first-generation channel 10 and the second-generation channel 20 have substantially identical shapes. However, they may have different shapes. The shape of the third-generation channel 30 may also be the same as or different from the shape of the second-generation channel 20.

When the taper angle α is small, the Laplace pressure becomes insufficient, leading to a low ability to transport liquid droplets, and hence liquid droplets remain in the middle of the tapered channel portions 14 in some cases. When the taper angle α is large, the channel in each of the tapered channel portions 14 is widened, and hence liquid droplets remain in the middle of the tapered channel portions 14 in some cases.

Therefore, the taper angle α of each of the tapered channel portions 14 of the first-generation channel 10 is preferably from 1° to 10°, more preferably from 2° to 9°. The second-generation channel 20 is substantially identical in shape to the first-generation channel 10, and hence the taper angle of each of the tapered channel portions 24 of the second-generation channel 20 is also preferably from 1° to 10°, more preferably from 2° to 9°. With such configuration, liquid droplets are more efficiently collected.

The liquid droplet collection device of the present invention is not limited to the purpose of collecting water vapor, rainwater, perspiration, or the like, and is also applicable to, for example, the control of alignment of polymer fibers and the control of chemotaxis of a cell population.

The present invention may also have the following configurations.

Item 1. According to one embodiment of the present invention, there is provided a liquid droplet collection device including: a substrate having a hydrophobic surface; and a hydrophilic channel arranged in the hydrophobic surface, wherein the hydrophilic channel includes: a first-generation channel including a plurality of tapered channel portions radially extending from an origin point and monotonically tapering with increasing distance from the origin point; and a second-generation channel that includes a plurality of tapered channel portions radially extending from an origin point and monotonically tapering with increasing distance from the origin point, and is scaled down in size as compared to the first-generation channel, wherein the second-generation channel is joined to the first-generation channel to face the same direction as the first-generation channel, and wherein one of the tapered channel portions of the second-generation channel overlaps a distal end portion of one of the tapered channel portions of the first-generation channel, and the hydrophilic channel monotonically tapers from a proximal end of one of the tapered channel portions of the first-generation channel to a distal end of one of the tapered channel portions of the second-generation channel.

Item 2. The liquid droplet collection device according to Item 1, wherein the second-generation channel has a substantially identical shape to a shape of the first-generation channel.

Item 3. The liquid droplet collection device according to Item 1 or 2, wherein the liquid droplet collection device has a fractal structure in which the second-generation channel is joined to each of the plurality of tapered channel portions of the first-generation channel, and in which scaled down channels are repeated through channels of a plurality of descending generations.

Item 4. The liquid collection device according to Item 3, wherein a generation number counted from a first generation of the fractal structure is from 2 to 9.

Item 5. The liquid collection device according to any one of Items 1 to 4, wherein each of the tapered channel portions of the first-generation channel has a taper angle of from 20 to 90.

Item 6. The liquid collection device according to any one of Items 1 to 5, wherein the plurality of tapered channel portions of the first-generation channel are three or four tapered channel portions.

Item 7. The liquid collection device according to any one of Items 1 to 5, wherein the plurality of tapered channel portions of the first-generation channel are three tapered channel portions, and the second-generation channel is further arranged in such a manner that the origin point of the first-generation channel and the origin point of the second-generation channel overlap each other, and in a direction rotationally symmetric by 180° with respect to the first-generation channel.

Item 8. The liquid collection device according to Item 1, wherein the hydrophilic channel forms an n-gonal region (n≥4), and the n-gonal region is divided into n−2 triangular regions by an imaginary line segment connecting an origin point serving as one of vertices of the n-gon and another vertex of the n-gon, and wherein, in each of the triangular regions, n−2 channel portions branched from the origin point and respectively passing in the triangular regions each form one of three channel portions of the first-generation channel, and the second-generation channel is joined to each of the three channel portions of the first-generation channel.

Item 9. The liquid collection device according to Item 1, wherein the hydrophilic channel forms an n-gonal region (n≥3), which is divided into n triangular regions by imaginary line segments each connecting an origin point present in the n-gonal region and a vertex of the n-gon, and wherein, in each of the triangular regions, n channels branched from the origin point and respectively passing in the n triangular regions each form one of three channels of the first-generation channel, and the second-generation channel is joined to each of the three channels of the first-generation channel.

The present invention is more specifically described below by way of Examples, but the present invention is not limited thereto.

EXAMPLES

Example 1 Production of Liquid Droplet Collection Device and Evaluation of Ability to Collect Water Droplets (Methods)

An ethanol mixed dispersion containing titanium oxide and Capstone™ ST-100 was sprayed on the surface of a film of polyethylene terephthalate (PET) and was dried to provide a hydrophobic coating. After that, the thickness of the hydrophobic coating was evaluated with a step gauge. The hydrophobic coating was measured for contact angles before and after irradiation with ultraviolet light to evaluate hydrophilicity. Further, a negative photomask of a space-filling tree structure corresponding to the hydrophilic channel of a liquid droplet collection device was produced, and the film was irradiated with ultraviolet light to be patterned with superhydrophilic open channels.

Water droplets were sprayed on the produced open channels through a spray nozzle, and then the shapes and distribution of liquid droplets on the substrate were observed with an optical microscope and a 3D shape-measuring machine (Keyence VR-3000), and the volume of liquid accumulated at the center of the substrate (within a circle having a radius of 2 mm) was measured.

Further, the collection of water droplets was observed while changing the generation number of channels and the taper angle of tapered channels.

Results

A hydrophobic coating having a thickness of 16.7±2.8 μm was formed. In addition, the contact angle of a water droplet, which was 156° before the ultraviolet light irradiation of the hydrophobic coating, was changed to 7° after the ultraviolet light irradiation, demonstrating that a superhydrophobic surface was formed on the substrate by the coating and the surface was rendered superhydrophilic by the ultraviolet light irradiation.

Figure 16:
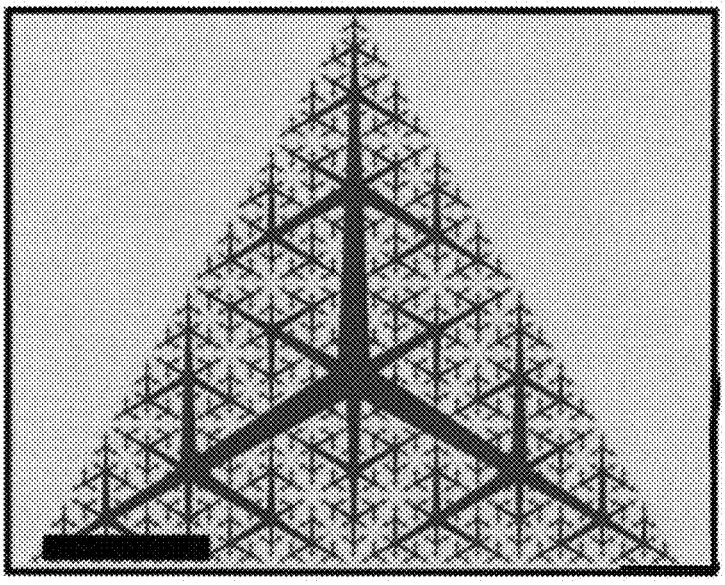
FIG. 16 is a schematic view of a liquid droplet collection device including a space-filling tree-shaped superhydrophilic channel of Example. The scale bar in the lower left corner represents 5 mm.
Figure 17A:
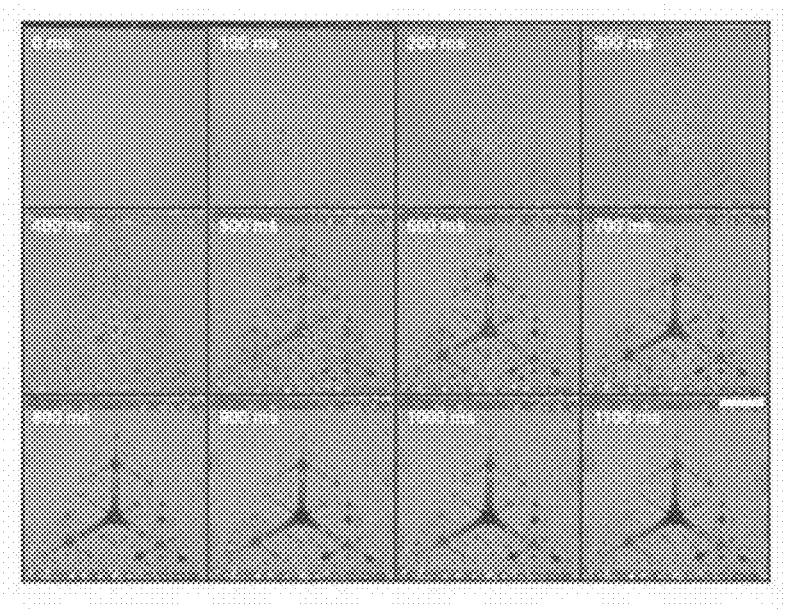
FIG. 17A and FIG. 17B are high-speed microscopic snapshots showing a manner in which water droplets sprayed to the liquid droplet collection device of FIG. 16 are accumulated at and around the center of a first-generation channel.
Figure 17B:
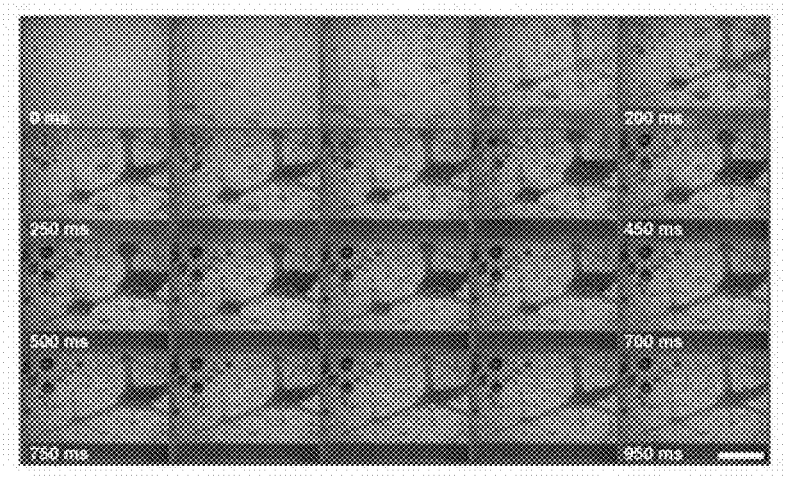

The superhydrophobic film was irradiated with ultraviolet light via the photomask to be patterned with superhydrophilic channels in the shape of a space-filling tree branched from a first generation to a sixth generation, with a gradient in width. The taper angle of each channel portion was set to 5°. FIG. 16 is a schematic view of such space-filling tree, in which the portion of the hydrophilic channel is colored in order to facilitate understanding. When water droplets were sprayed on the superhydrophilic channels through a spray nozzle, a manner in which water droplets were accumulated at and around the center of the first-generation channel from the entire pattern within 1 second was observed (FIG. 17A and FIG. 17B).

Figure 18A:
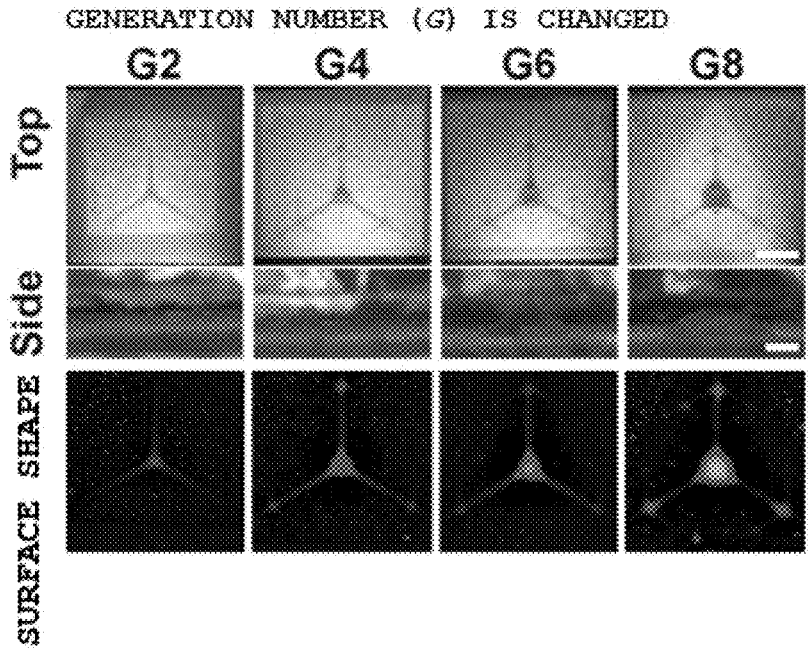
FIG. 18A and FIG. 18B are photographs and a graph showing a relationship between the generation number of channels and water droplet collection performance.
Figure 18B:
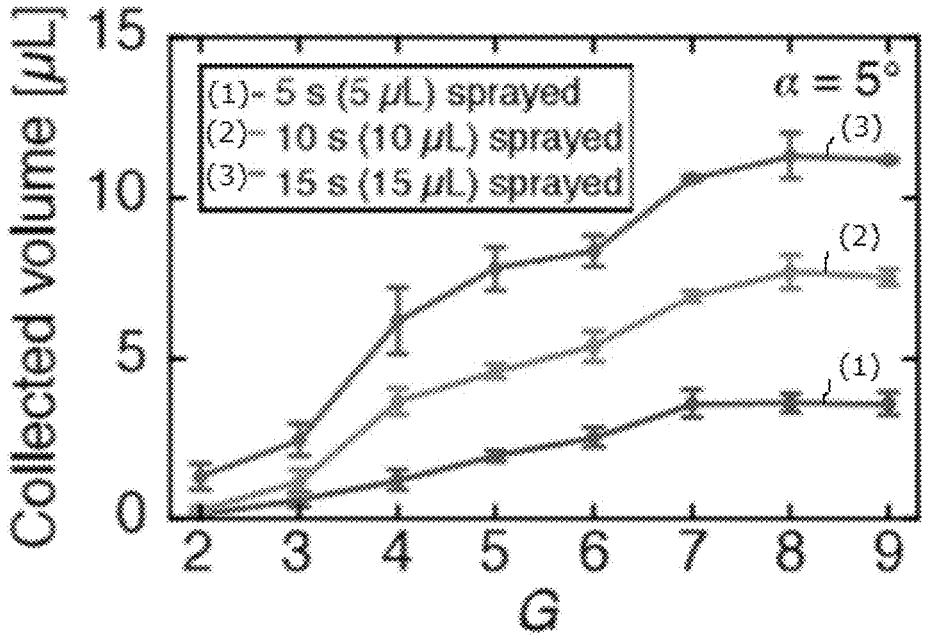

When the number of branching of the hydrophilic channel (generation number) was changed, the volume of liquid droplets collected at and around the center in the middle of the channel monotonically increased with the generation number until an eighth generation (FIG. 18A and FIG. 18B), and up to 74±9% of all liquid droplets were accumulated in the circle having a radius of 2 mm from the center of the first-generation channel. This is presumably because, when the generation number increased, the channels were more densely extended on the substrate, resulting in an increase in the total volume of liquid droplets capable of being collected from the entire substrate.

In the case of channels having a tree structure, which was not a space-filling tree, of Non-patent Literature 2, the collection efficiency was only 25%, revealing the advantage of the fractal channels of this Example efficiently filling a flat surface.

Figure 19A:
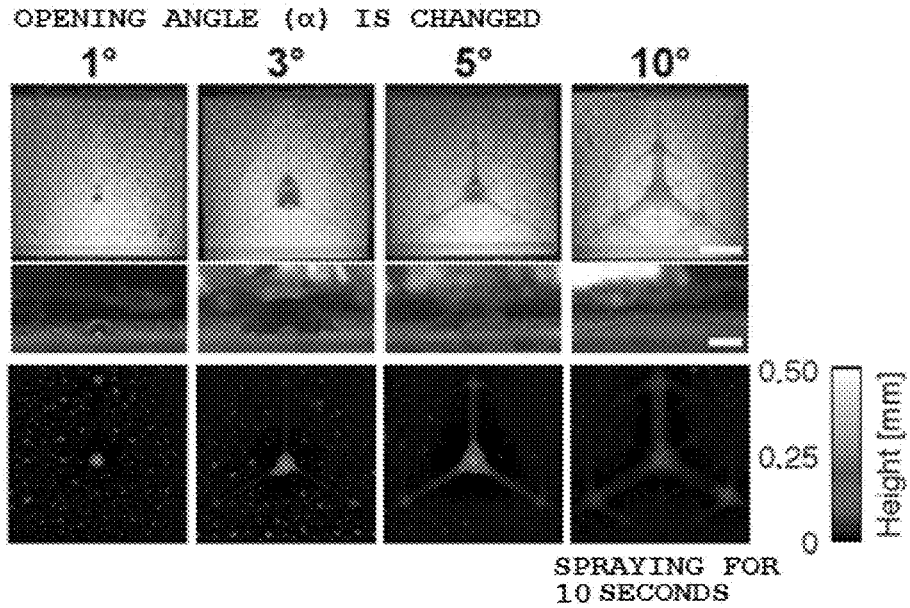
FIG. 19A and FIG. 19B are photographs and a graph showing a relationship between the taper angle of each tapered channel portion of the channels and water droplet collection performance.
Figure 19B:
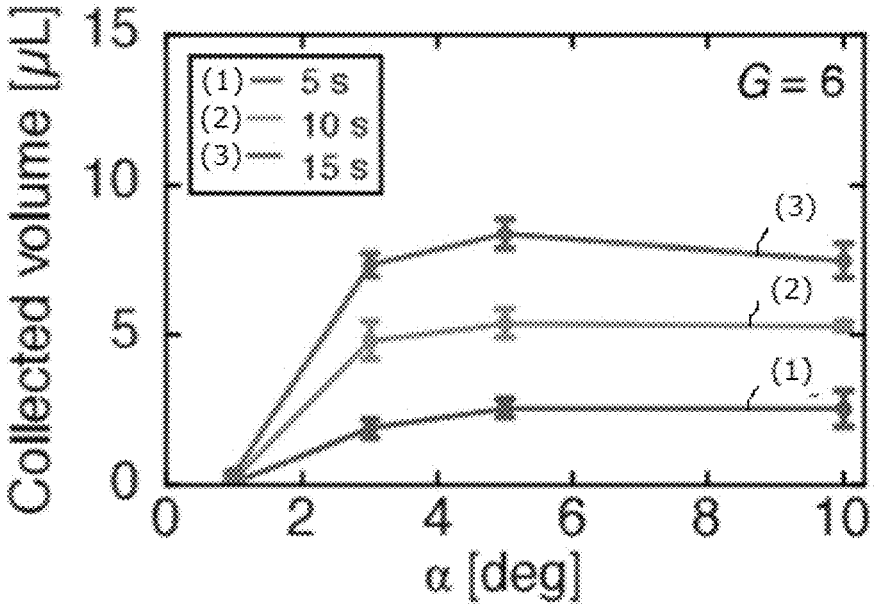

Further, when the taper angle of the tapered channels was changed, surprisingly, it was found that: water droplets remained in the middle of the channels at 1° and liquid droplets remained in peripheral wide channels at 10°, resulting in a reduction in collection efficiency of water droplets in both cases; and the ability to collect water droplets was able to be dramatically improved at a taper angle of from 2° to 9° (FIG. 19A and FIG. 19B).

The invention claimed is:

1. A liquid droplet collection device comprising:

a substrate having a hydrophobic surface; and a hydrophilic channel arranged in the hydrophobic surface, wherein the hydrophilic channel includes:

a first-generation channel including a plurality of tapered channel portions radially extending from an origin point and monotonically tapering with increasing distance from the origin point; and a second-generation channel that includes a plurality of tapered channel portions radially extending from an origin point and monotonically tapering with increasing distance from the origin point, and is scaled down in size as compared to the first-generation channel, wherein the second-generation channel is joined to the first-generation channel to face the same direction as the first-generation channel, and wherein one of the tapered channel portions of the second-generation channel overlaps a distal end portion of one of the tapered channel portions of the first-generation channel, and the hydrophilic channel monotonically tapers from a proximal end of one of the tapered channel portions of the first-generation channel to a distal end of one of the tapered channel portions of the second-generation channel.

2. The liquid droplet collection device according to claim 1, wherein the second-generation channel has a substantially identical shape to a shape of the first-generation channel.

3. The liquid droplet collection device according to claim 1, wherein the liquid droplet collection device has a fractal structure in which the second-generation channel is joined to each of the plurality of tapered channel portions of the first-generation channel, and in which scaled down channels are repeated through channels of a plurality of descending generations.

4. The liquid collection device according to claim 3, wherein a generation number counted from a first generation of the fractal structure is from 2 to 9.

5. The liquid collection device according to claim 1, wherein each of the tapered channel portions of the first-generation channel has a taper angle of from 2° to 9°.

6. The liquid collection device according to claim 1, wherein the plurality of tapered channel portions of the first-generation channel are three or four tapered channel portions.

7. The liquid collection device according to claim 1, wherein the plurality of tapered channel portions of the first-generation channel are three tapered channel portions, and the second-generation channel is further arranged in such a manner that the origin point of the first-generation channel and the origin point of the second-generation channel overlap each other, and in a direction rotationally symmetric by 180° with respect to the first-generation channel.

8. The liquid collection device according to claim 1, wherein the hydrophilic channel forms an n-gonal region ($n \geq 4$), and the n-gonal region is divided into n−2 triangular regions by an imaginary line segment connecting an origin point serving as one of vertices of the n-gon and another vertex of the n-gon, and wherein, in each of the triangular regions, n−2 channel portions branched from the origin point and respectively passing in the triangular regions each form one of three channel portions of the first-generation channel, and the second-generation channel is joined to each of the three channel portions of the first-generation channel.

9. The liquid collection device according to claim 1, wherein the hydrophilic channel forms an n-gonal region ($n \geq 3$), which is divided into n triangular regions by imaginary line segments each connecting an origin point present in the n-gonal region and a vertex of the n-gon, and wherein, in each of the triangular regions, n channels branched from the origin point and respectively passing in the n triangular regions each form one of three channels of the first-generation channel, and the second-generation channel is joined to each of the three channels of the first-generation channel.

* * * * *